US011873185B2

(12) United States Patent
Schiffers et al.

(10) Patent No.: US 11,873,185 B2
(45) Date of Patent: Jan. 16, 2024

(54) TEXTILE MACHINE PRODUCING CROSS-WOUND PACKAGES AND METHOD FOR OPERATING A TEXTILE MACHINE PRODUCING CROSS-WOUND PACKAGES

(71) Applicant: Saurer Spinning Solutions GmbH & Co. KG, Uebach-Palenberg (DE)

(72) Inventors: Philipp Schiffers, Erkelenz-Gerderath (DE); Eduard Prediger, Mönchengladbach (DE); Harald Wassen, Schwalmtal (DE); Michael Spitzer, Monschau-Kalterherberg (DE); Dirk Brakensiek, Neuss (DE); Jonathan Sprecher, Aachen (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 328 days.

(21) Appl. No.: 17/211,555

(22) Filed: Mar. 24, 2021

(65) Prior Publication Data

US 2021/0300717 A1 Sep. 30, 2021

(30) Foreign Application Priority Data

Mar. 26, 2020 (DE) ..... 102020108339.4

(51) Int. Cl.
*B65H 67/06* (2006.01)
*B65H 67/04* (2006.01)

(52) U.S. Cl.
CPC ..... *B65H 67/068* (2013.01); *B65H 67/0405* (2013.01); *B65H 67/063* (2013.01); *B65H 67/064* (2013.01); *B65H 2701/31* (2013.01)

(58) Field of Classification Search
CPC ..... B65H 67/0405; B65H 67/0417; B65H 67/063; B65H 67/064; B65H 2701/31
See application file for complete search history.

(56) References Cited

U.S. PATENT DOCUMENTS

2018/0282910 A1* 10/2018 Brandl ..... B65H 67/068

FOREIGN PATENT DOCUMENTS

CN 108622738 A 10/2018
CN 108657883 A 10/2018
(Continued)

OTHER PUBLICATIONS

European Search Report, European Application No. EP 21164438, dated Aug. 2, 2021, 1 page.
(Continued)

*Primary Examiner* — William E Dondero
(74) *Attorney, Agent, or Firm* — Nelson Mullins Riley & Scarborough LLP

(57) ABSTRACT

A textile machine producing cross-wound packages with a plurality of identical workstations which are arranged in the area of the longitudinal sides of the textile machine and each of which has a winding device, and equipped with a tube supply device which includes a central tube magazine and at least one tube conveyor belt installed in the area of the longitudinal sides of the machine, in which case a cross-wound package can be removed, if necessary, from the winding device of the relevant workstation on the textile machine producing cross-wound packages and can be transferred to a cross-wound package transport device running the length of the machine, and an empty tube provided on the tube conveyor belt of the tube supply device can be inserted by means of a tube gripper into the winding device of the relevant workstation. The tube supply device is designed in such a way that the tube conveyor belt can be used as a tube accumulator for empty tubes during the operation of the textile machine producing cross-wound packages. In order to improve the efficiency of such a textile machine producing cross-wound packages, in particular to minimize significantly the tube delivery times arising in the event of yarn lot
(Continued)

changes at a textile machine producing cross-wound packages, a drive is connected to the at least one tube conveyor belt, which drive enables reversible operation of the tube conveyor belt.

12 Claims, 3 Drawing Sheets

(56) References Cited

FOREIGN PATENT DOCUMENTS

| | | | |
|---|---|---|---|
| DE | 2816418 | A1 | 10/1979 |
| DE | 4222723 | A1 | 1/1994 |
| DE | 4402143 | A1 | 10/1994 |
| DE | 4443818 | A1 | 6/1996 |
| DE | 19739557 | A1 | 3/1999 |
| DE | 10008036 | A1 | 8/2000 |
| DE | 19905856 | A1 | 8/2000 |
| DE | 102004012254 | A1 | 9/2005 |
| DE | 102007057921 | A1 | 6/2009 |
| DE | 102014001626 | A1 | 8/2015 |
| DE | 102017129700 | A1 | 6/2019 |
| EP | 0593808 | A1 | 4/1994 |
| EP | 3382072 | A1 | 10/2018 |

OTHER PUBLICATIONS

Search Report for German Application No. 102020108339.4, dated Nov. 12, 2020, all enclosed pages cited.
Examination Report for Indian Patent Application No. 202124011921, dated Feb. 4, 2022, all enclosed pages cited.

* cited by examiner

TEXTILE MACHINE PRODUCING CROSS-WOUND PACKAGES AND METHOD FOR OPERATING A TEXTILE MACHINE PRODUCING CROSS-WOUND PACKAGES

CROSS-REFERENCE TO RELATED APPLICATION

This application claims priority from German National Patent Application No. DE 102020108339.4, filed Mar. 26, 2020, entitled "Kreuzspulen herstellende Textilmaschine bzw. Verfahren zum Betreiben einer Kreuzspulen herstellenden Textilmaschine", the entire contents of which are incorporated herein by reference.

FIELD OF THE INVENTION

The present invention relates to a textile machine producing cross-wound packages, comprising:—a plurality of identical workstations, which are arranged in the area of the longitudinal sides of the textile machine and each of which has a winding device; and—a tube supply device, which has a central tube magazine, preferably arranged at an end of the machine, and has at least one tube conveyor belt installed in the area of the longitudinal sides of the machine, wherein preferably at least one service unit is movably arranged on the textile machine producing cross-wound packages, which service unit, if required, removes a cross-wound package that has, for example, reached a predefined diameter from the winding apparatus of the relevant workstation and transfers said cross-wound package to a cross-wound package transport device running the length of the machine and, by means of a tube gripper, inserts an empty tube, which is provided on one of the tube conveyor belts of the tube supply device, into the winding apparatus of the relevant workstation, the tube supply device being designed in such a way that the at least one tube conveyor belt can be used as a tube accumulator for empty tubes during the operation of the textile machine producing cross-wound packages. The present invention also relates to a method for operating such a textile machine.

BACKGROUND OF THE INVENTION

Textile machines producing cross-wound packages, which preferably have a plurality of identical workstations on both longitudinal sides of the machine and which have a tube supply device for empty tubes, have been known for a long time in various embodiments and have been described in the patent literature, in some cases quite extensively.

For example, German patent publication DE 44 02 143 A1 describes an open-end rotor spinning machine, which has two rows of workstations running in the longitudinal machine direction and a transport device arranged between the rows of workstations for cross-wound packages and/or empty tubes. The transport device in this case consists of a plurality of linked, circulating individual transport elements, each of which has a transport surface for forwarding a cross-wound package completed on the workstations or an empty tube required on the workstations.

A comparable transport device also arranged between the rows of workstations of an open-end rotor spinning machine is also described in German patent publication DE 44 43 818 B4. However, this transport device of prior art is designed in such a way that a cross-wound package and an empty tube can be conveyed on it at the same time.

Furthermore, German patent publication DE 199 05 856 A1 discloses open-end rotor spinning machines which have a transport device for transporting away finished cross-wound packages and a separate tube supply device for providing fresh empty tubes. In this case, the tube supply device includes a tube magazine arranged at the end of the machine and two tube conveyor belts that run the length of the machine which are arranged on the longitudinal sides of the textile machine above the workstations. The workstations of such open-end rotor spinning machines are supplied by an automatically operating service unit which, amongst other things, has a storage for an empty tube. In this device of prior art, the service unit requests a new empty tube from the tube magazine after a cross-wound package/empty tube change, which new empty tube is then delivered via one of the tube conveyor belts.

Like the tube supply devices, the service units of such open-end spinning machines can also have various embodiments.

For example service units which are designed as piecer carriages have long since been disclosed. Such service units become active in particular when a workstation has to be pieced up again after a thread break. However, such service units also become active when a cross-wound package/empty tube change is due at one of the workstations. Accordingly, the service units of prior art have various devices which are used either in connection with the piecing up of a workstation again or in a cross-wound package/empty tube change. However, the service units of open-end spinning machines can also be designed as cleaner and changer carriages, as is described for example in German patent publication DE 10 2017 129 700 A1.

Such cleaner and changer carriages are generally used open-end spinning machines that have workstations that are autonomous to a large extent. Such workstations, which are autonomous to a large extent, each has, as has already been disclosed, in addition to an open-end spinning device for preparing a thread and a winding device for producing a cross-wound package, further functional elements which enable the workstations to piece themselves up immediately following a thread break. This means autonomous workstations only require the help of a traversable service unit if a workstation has to be cleaned or if a cross-wound package/empty tube change is required at one of the workstations and will also require a new piecing thread.

In the case of a cross-wound package/empty tube change, which is known to be necessary when the cross-wound package has reached a specified diameter at one of the workstations and has to be exchanged for a new empty tube, what is referred to as a work order is issued by the relevant workstation, whereupon the cleaner and changer carriage moves to this workstation and positions itself in front of the workstation. The affected workstation also requests an empty tube from the tube magazine arranged at the end of the machine, the empty tube being transported to the cleaner and changer carriage or to the relevant workstation via one of the tube transport tracks of the tube supply device.

The cleaner and changer carriage, which in the meantime has transferred the completed cross-wound package from the package cradle of the workstation concerned to a cross-wound package transport device running the length of the textile machine, waits for the requested empty tube and inserts it into the package cradle of the workstation after receiving it. The cleaner and changer carriage has a tube gripper for this purpose, with which the delivered empty tube is removed from the tube transport track and inserted into the package cradle of the workstation. Finally, the cleaner and changer carriage ensures that the open-end spinning device of the workstation is newly pieced up using what is referred to as an auxiliary thread and the thread newly prepared in the open-end spinning device is pieced up to the empty tube which was previously changed into the package cradle.

However, this method of prior art suffers from the disadvantage that the relevant tube conveyor belt must be free before each new empty tube request, i.e. a new empty tube request is only processed when the tube conveyor belt is no longer blocked by an empty tube that is still travelling.

In addition, in the method of prior art, the straightforward transport time of an empty tube is often relatively long, for example, because the workstation requesting it is arranged relatively far away from the tube magazine, this often being the case because it is expedient, in the sense of a high economic efficiency of such textile machines, for the largest possible number of workstations per open-end rotor spinning machine to be selected.

As a result, the tube throughput is often relatively low with this method of prior art.

A further disadvantage of the method of prior art is that the efficiency of such textile machines is usually considerably reduced if a yarn lot in the block runs out on a textile machine producing cross-wound packages, i.e. if, for example, all the workstations on one longitudinal side of the machine are completed at the same time and accordingly want to restart at the same time. Unnecessary waiting times occur because the tube supply takes a considerably longer time than the cleaner and changer carriage needs for processing the workstations. As already indicated above, such waiting times have a negative overall effect on the efficiency of such open-end spinning machines.

In order to shorten the transport times of the empty tubes in textile machines producing long cross-wound packages, a method or a device has consequently already been developed in the past which works with an intermediate storage. German patent publication DE 10 2004 012 254 B4 describes, for example, an open-end spinning machine or a method in which an open-end spinning machine is equipped with a tube supply device with tube conveyor belts that are each divided into two longitudinal portions. Between the two longitudinal portions of the tube conveyor belts, an empty tube retaining device is inserted in each case, which forms an intermediate storage. By means of this empty tube retaining device, the transport path of an empty tube should be shortened and thus the supply of a workstation with a fresh empty tube should be accelerated.

German patent publication DE 28 16 418 A1 discloses a tube conveyor belt running around a spinning machine, which tube conveyor belt can store empty tubes. In this way, a time delay in the supply of empty tubes to the spinning positions should be avoided. Nevertheless, in the worst case scenario, especially during lot changes, an empty tube has to be transported around the entire textile machine once. In addition, the concept leads to very long conveyor belts, since the conveyor belt must be at least twice the machine length. Due to the expansion of the conveyor belt during operation, the accuracy of positioning of the tubes in front of the spinning positions worsens with increasing length of the conveyor belt.

In the textile machine industry, in the context of interlinking several textile machines running in what is referred to as multi-lot operation, it has also long been the state of the art to make the different yarn lots identifiable for the operating personnel, e.g. by means of package tubes marked in different colours.

It has already been disclosed not only that roving packages are identified by coloured, reusable package tubes but also that spinning cops are wound on coloured, spinning cop tubes that are also reusable. Such reusable tubes are usually made of a sturdy polymer material and coloured in one colour.

In order to automatically ensure a reliable differentiation between such tubes during machine operation, sensor devices are often used in such linked systems, configured for example as colour sensors. Such commercially available colour sensors can distinguish up to eight different tube colours. The use of such colour sensors in connection with reusable, single-colour roving tubes or reusable, single-colour spinning cop tubes has proven quite successful in practice. However, such colour sensors cannot be used to distinguish between tubes which are not of a single colour but have other characteristic features. Such "disposable" tubes, which are generally inexpensively made from cardboard, have, for example, a pattern or a certain imprint on the tube surface which identifies a particular yarn lot.

A method or a device for identifying such "disposable" tubes is described in German patent publication DE 10 2007 057 921 A1, for example. The device of prior art includes a CCD camera for forming an image of the package tube and a light source, in which case a digital image processing device is connected to the CCD camera. In the image processing device, the image of the package tube to be identified is checked for characteristic features and compared with images of already classified package tubes that are stored in a memory. If the characteristic features of the image of the package tube match one of the images of an already classified package tube, the package tube to be checked is considered to have been identified.

Furthermore, it has been disclosed, for example in European Patent Publication EP 0 593 808 A1, for identification markings to be arranged in the form of electronic information carriers, referred to as transponders, on textile packages or their tubes. These electronic transponders, which are passive in themselves, can be activated electromagnetically by sensor devices to emit an individual identification which is read into a memory and evaluation unit.

SUMMARY OF THE INVENTION

Proceeding from the prior art mentioned above, the problem addressed by the present invention is one of improving the tube supply devices of prior art, and in particular minimizing the tube supply times that arise on a textile machine producing cross-wound packages during cross-wound package/empty tube changes and/or yarn lot changes.

This problem is solved according to the invention in that a drive is connected to the at least one tube conveyor belt, which drive enables reversible operation of the tube conveyor belt.

Advantageous embodiments of the device according to the present invention and of the method according to the present invention are the subject matter of the dependent claims.

The present invention is in principle applicable to all textile machines producing cross-wound packages. These are in particular open-end spinning machines, e.g. a rotor spinning machine and an air-spinning machine, as well as winding machines.

The design and use according to the present invention of the tube conveyor belt(s) of the tube supply device of the textile machine producing cross-wound packages offers the advantage that, in this way, the transport paths of the empty tubes to the workstations are significantly shortened. This means that the tube conveyor belts can be controlled in such a way that one of the empty tubes stored on the tube conveyor belts can be transferred immediately, at a fast speed and as required to a workstation requesting it, and can be inserted there into the package cradle of the workstation concerned by a traversable service unit positioned at the workstation or by devices of the workstation.

Particularly during yarn lot changes, the simultaneous function of the tube conveyor belts as transport and storage devices can easily ensure a fast and reliable supply of empty tubes to the workstations, something which has a very positive effect on the efficiency of the textile machine producing cross-wound packages.

According to the present invention, drives are connected to the tube conveyor belts, which drives enable reversible and exact operation of the tube conveyor belts. This ensures that the delivery path of the empty tubes is optimized and thus the delivery times of the empty tubes that arise during the operation of the textile machine are very short for all workstations of the textile machine.

Preferably, means for blocking the empty tubes are assigned to a tube conveyor belt. Only the empty tube should be blocked thereby, whereas the tube conveyor belt continues to be driven. In this way, gaps on the tube conveyor belt, which are created by the removal of empty tubes from the tube conveyor belt for insertion into the winding device of a workstation, can be closed again. These means are preferably arranged at an end of the tube conveyor belt. When an empty tube has reached the end of the tube conveyor belt, the tube conveyor belt is first driven further in the corresponding direction. This pushes the empty tubes together on the tube conveyor belt and closes gaps. Then free positions for empty tubes are created at the other end of the tube conveyor belt. By reversing the drive of the tube conveyor belt, the free positions can then be filled again by means of a central tube magazine preferably arranged at the other end of the tube conveyor belt.

The drives are preferably designed as stepper motors, since such stepper motors are proven, low-cost mass-produced components. In addition, stepper motors are also relatively uncomplicated in terms of their control and can therefore be implemented at low cost.

In a further advantageous embodiment, a plurality of empty tubes can be stored on the tube conveyor belt(s) of the tube supply device during operation of the textile machine.

Preferably, workstations are arranged on both longitudinal sides of the textile machine. In such a textile machine, there are preferably two tube conveyor belts arranged in the area of the two longitudinal sides of the textile machine. That means one tube conveyor belt is preferably assigned to each longitudinal side of the machine. The length of the conveyor belt then corresponds at most to the length of the textile machine.

The empty tubes stored on one of the tube conveyor belts are configured identically if all workstations of the corresponding longitudinal side of the machine are producing the same yarn lot. That is, if take-up packages of the same yarn lot are being produced at all workstations of one longitudinal side of a textile machine producing cross-wound packages, there are only empty tubes of the type required for this yarn lot on the associated tube conveyor belt. These identical empty tubes stored on the tube conveyor belt are reliably recognized by the service unit or the workstations and can quickly be fed to each of the workstations on this longitudinal side of the machine if necessary.

In a further embodiment, if different yarn lots are prepared on the workstations of one longitudinal side of the machine, different empty tubes are also stored on the associated tube conveyor belt. The empty tubes are identified for each specific lot.

Such a lot-specific identification of the empty tubes can be effected, for example, by a specific colouring of the empty tubes or by the fact that the empty tubes have a special pattern.

In a further, alternative embodiment, there is provision for each of the empty tubes to be equipped with an RFID transponder which has a lot-specific identification. By means of the identification of such RFID transponders, correct lot-specific allocation of the empty tubes is possible in a straightforward manner.

In a further advantageous embodiment, the service unit or the workstations is/are equipped with a tube detection device which, depending on the design or equipment of the empty tube that is to be detected, is configured either as a colour sensor or CCD camera or as an RFID reader. Such tube detection devices have been disclosed and are in practical use in general mechanical engineering as well as in the textile machine industry.

The service unit or workstations further preferably include a tube gripper that is configured to pick up an empty tube from the tube conveyor correctly and to transfer it to the package cradle of the winding device of a workstation. This means that the tube gripper is designed in such a way that, regardless of the direction from which the empty tube is delivered by the tube conveyor belt, it can stop the empty tube, take it off the tube conveyor belt and change it into the package cradle of the workstation in question.

The method according to the present invention for operating a textile machine producing cross-wound packages, which is preferably served by a service unit and has a tube supply device with a reversible, precisely drivable tube conveyor belt, which can be used during operation of the textile machine producing cross-wound packages along large parts of its length as a tube accumulator for a plurality of empty tubes, has the advantage that in this way the transport paths of the individual empty tubes and thus the waiting times of the service unit or the workstation can be minimized. This means that by controlling a tube conveyor belt as required, empty tubes can be transferred quickly and easily to workstations requesting them, and inserted there into the package cradle of the workstation in question.

According to the present invention, the tube conveyor belt is reversed when required. This means that the nearest suitable empty tube can be supplied to the workstation requesting it as quickly as possible, irrespective of the position of the empty tube in relation to the workstation. The tube conveyor belt can also be reversed when the tubes have reached the end of the tube conveyor belt.

BRIEF DESCRIPTION OF THE DRAWINGS

Further details of the invention can be taken from the embodiment example explained below on the basis of the drawings.

In the drawings.

DESCRIPTION OF THE PREFERRED EMBODIMENTS

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

Figure 1:
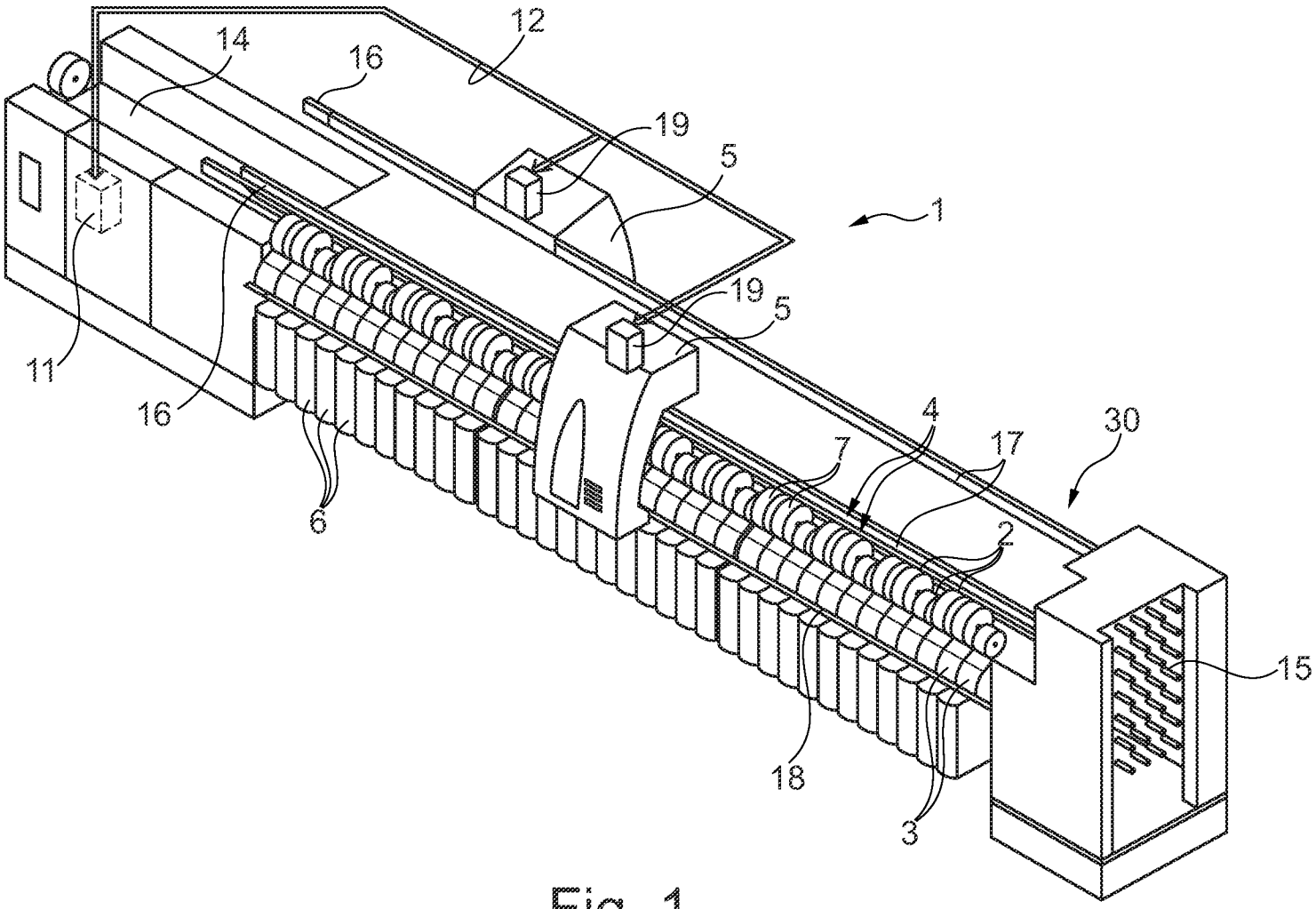
FIG. 1 shows a perspective view of an open-end spinning machine with a plurality of workstations, a tube magazine arranged at the end of the machine, a tube supply device which has a tube conveyor belt on each of the two longitudinal sides of the machine, the tube conveyor belts being designed and controllable in such a way that a plurality of empty tubes can be stored on each one of them.

FIG. 1 shows a textile machine producing cross-wound packages, in the embodiment example an open-end spinning machine 1 which has a tube supply device which can be used in accordance with the present invention. As is known, open-end spinning machines 1 of this kind have a plurality of identical workstations 2 arranged on both longitudinal sides of the textile machine 1, between end frames.

In the present embodiment example, the workstations are designed as autonomous workstations 2, i.e. the workstations 2 are each equipped with an open-end spinning device 3, a winding device 4 as well as a suction nozzle 29 which can be subjected to a vacuum. During the spinning/winding operation of the textile machine 1, the workstations 2 are supplied by service units 5; in the embodiment example this is effected by two cleaner and changer carriages, each of identical design. The service units 5 are guided on guide rails 17, 18 and can be moved at least along the workstations 2 of a longitudinal side of the open-end spinning machine 1.

Figure 2:
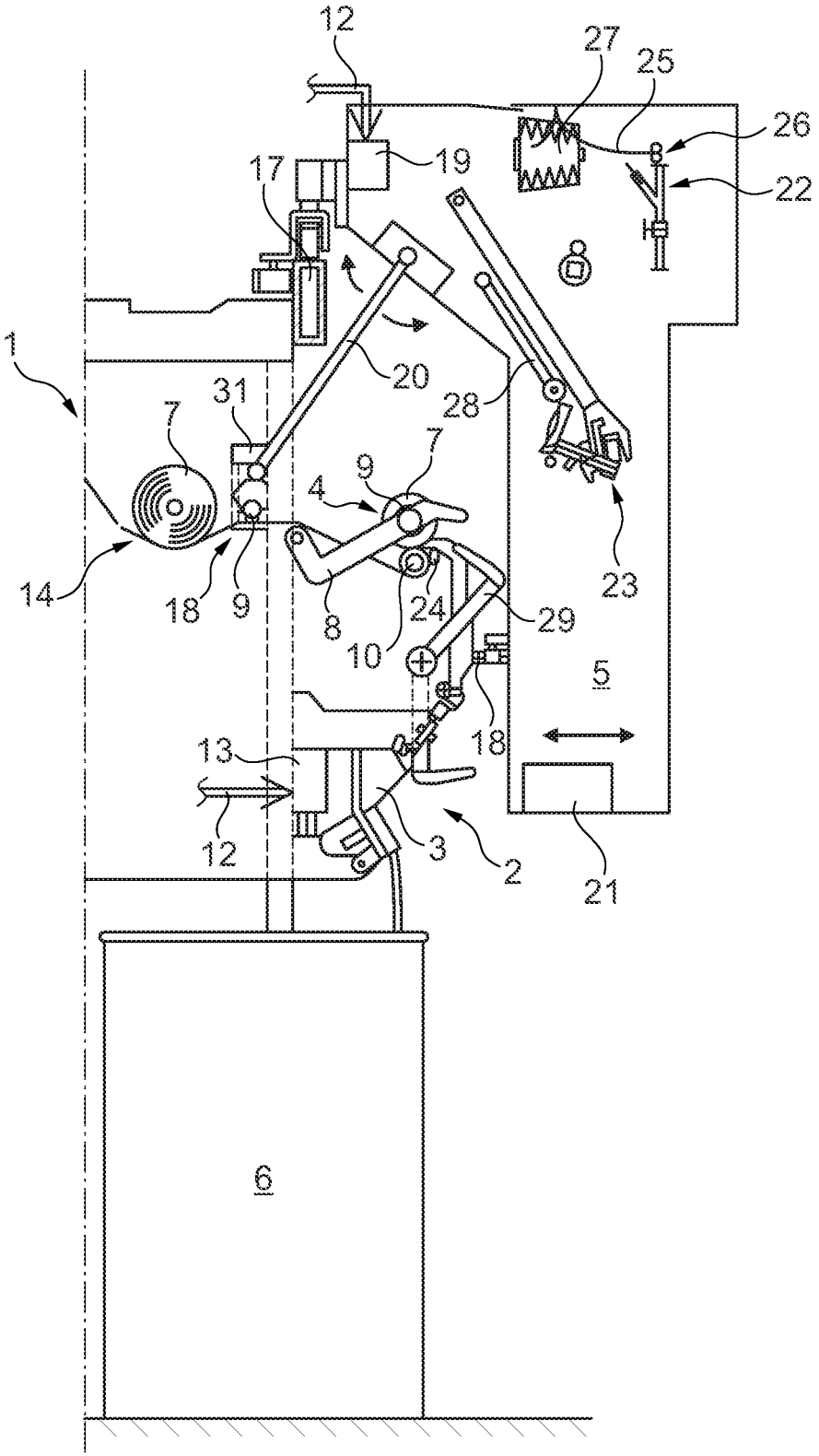
FIG. 2 shows a side view of an autonomous workstation of an open-end rotor spinning machine with a cleaner and changer carriage positioned in front of the workstation.

As is known, in the open-end spinning devices 3 of the workstations 2, slivers that are stored in spinning cans 6, are spun into threads, which are then wound into cross-wound packages 7 on the winding devices 4 of the workstations 2. The winding devices 4, as depicted in FIG. 2, are each equipped with a package cradle 8 for the pivotable holding of an empty tube 9 or a cross-wound package 7, a winding drum 10 for rotating these elements correctly as well as with a thread traversing device 24.

The open-end spinning machine 1 also has a central control unit 11 which is connected not only to the control devices 19 of the service unit 5 but also to the control devices 13 of the workstations 2 via a bus system 12.

Moreover, such open-end spinning machines 1 have a cross-wound package transport device 14 for removing completed cross-wound packages 7 and a tube supply device 30 which essentially consists of a central tube magazine 15 arranged at the end of the machine as well as tube conveyor belts 16.

Figure 3:
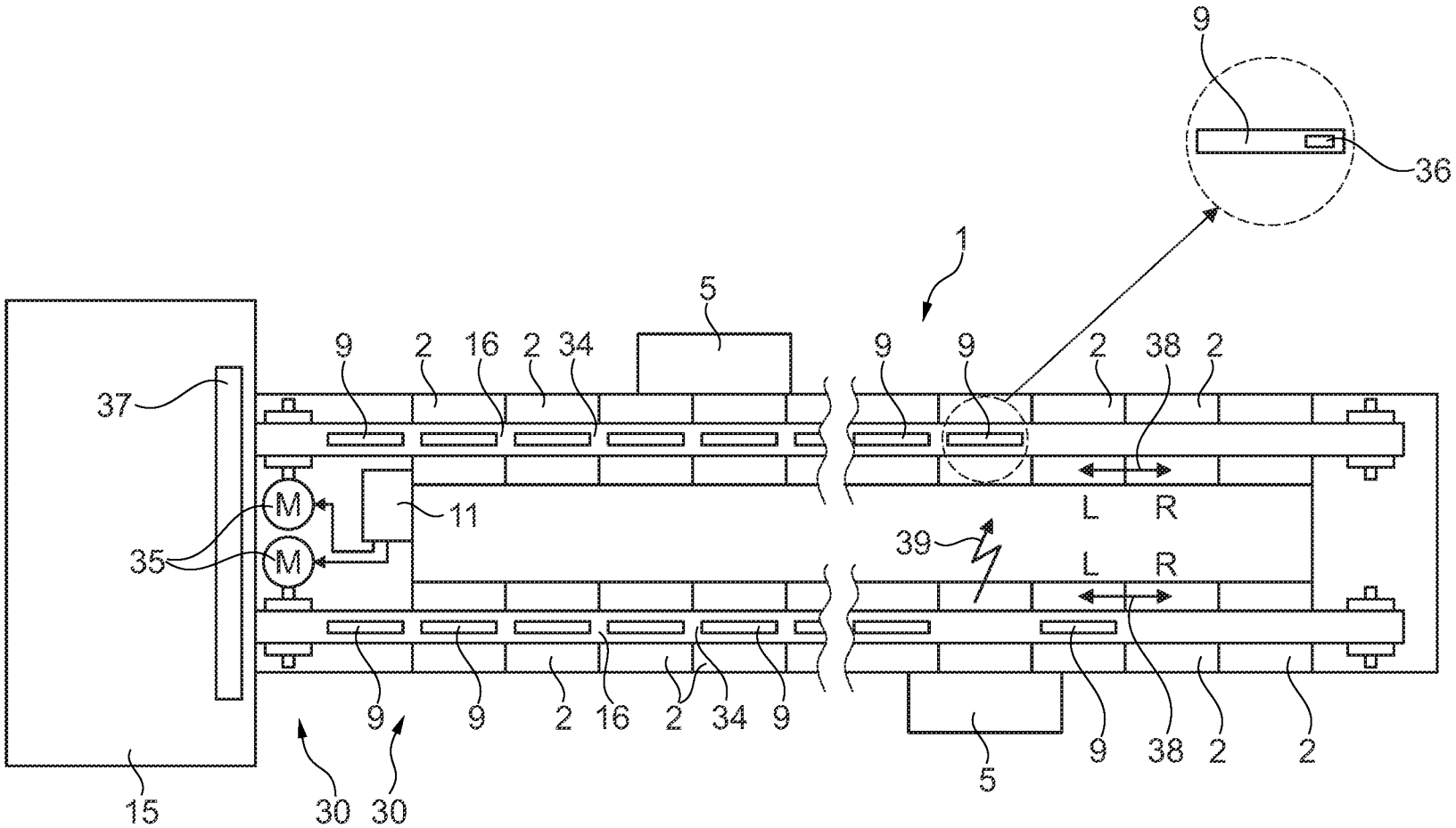
FIG. 3 shows a schematic plan view of an open-end spinning machine with a tube supply device, the tube conveyor belts of which function as tube accumulators.

The tube conveyor belts 16 can also function as tube accumulators 34 during the spinning/winding operation of the open-end spinning machine 1, as shown in FIG. 3, i.e. a plurality of empty tubes 9 can be constantly stored on the tube conveyor belts 16 during the spinning/winding operation of the open-end spinning machine 1.

The cleaner and changer carriages 5 can, as shown schematically in FIG. 2 and described in relative detail, for example, in German Patent Publication DE 44 43 818 B4, each be moved along the workstations 2 on guide rails 17, 18, which are arranged at or on the open-end spinning machine 1, and can be positioned at one of the workstations 2 if required. The cleaner and changer carriages 5 each have various handling devices which enable the service units to clean a workstation or to perform a cross-wound package/empty tube change at a workstation 2 when required.

Such service units 5 are equipped, for example, with a device 21, shown very schematically, for cleaning the open-end spinning devices 3, an auxiliary thread delivery device 22 for providing a piecing thread 25, a pivotally mounted thread delivery tube 28 as well as with a thread positioning and repositioning device 23 which has, among other things, what is referred to as a package cradle opener (not shown in greater detail). In this case, the auxiliary thread delivery device 22 is preferably provided with a reserve package 27 and a thread delivery unit 26 which, when required, draws the piecing thread 25 from the reserve package 27.

Furthermore, such cleaner and changer carriages 5 are equipped with a tube gripper 20, which is only shown schematically in FIG. 2. By means of the tube gripper 20, an empty tube 9 can if necessary be picked up from one of the tube conveyor belts 16 acting, for example, as a tube accumulator 34 and transferred to the package cradle 8 of the workstation 2.

According to an advantageous embodiment, the tube gripper 20 is configured in this case to pick up an empty tube 9, which is standing ready or has been delivered on the tube conveyor belt 16, correctly from the tube conveyor belt 16 and transfer it to the package cradle 8 of the workstation 2, irrespective of the transport direction R or L in which the empty tube 9 is delivered.

Advantageously, the cleaner and changer carriage 5 is further equipped with a tube detection device 31 which is arranged, for example, in the area of the gripping device of the tube gripper 20. In this case, the tube detection device 31 is configured in a manner adapted to the design of the empty tubes 9 that are to be identified, for example as a colour sensor or as an RFID reader.

FIG. 3 shows a schematic plan view of an open-end spinning machine 1, which has a plurality of identical, preferably autonomous workstations 2 and which is equipped with a tube supply device 30, the tube conveyor belts 16 of which can also function as tube accumulators 34 during the spinning/winding operation of the open-end spinning machine 1.

As can be seen, the tube supply device 30 has a tube magazine 15, which is arranged at an end of the machine and comprises a tube distribution device 37, and two tube conveyor belts 16, which run the length of the machine and can be reversibly or reversingly driven by means of electric drives 35. The electric drives 35, for example stepper motors, are connected to the central control unit 11 of the open-end rotor spinning machine 1. As already indicated above, the tube conveyor belts 16 can also function as tube accumulators 34 during the spinning/winding operation of the textile machine; in other words, the tube conveyor belts 16 loaded with a plurality of empty tubes 9 can if required be reversibly driven either in the running direction R or in the running direction L, as indicated by the double arrows 38, so that empty tubes 9 stored on them can be conveyed within the shortest possible time, irrespective of the position of a workstation 2 requesting it. The associated service unit 5 also positions itself at the workstation 2 concerned and inserts the empty tube 9, which is already present or has been delivered, into the package cradle 8 of the workstation 2.

Function of the device or method according to the present invention:

At the beginning of the spinning/winding process of the open-end spinning machine 1 and/or before a yarn lot change, the tube distribution device 37 of the tube magazine 15 first loads the tube conveyor belts 16 of the tube supply device 30 with a plurality of empty tubes 9 of the yarn lot which is being processed, or is about to be processed, on the workstations 2 of the longitudinal side of the machine in question.

If, during the spinning/winding process of the open-end spinning machine 1, an action is required at one of the workstations 2, e.g. if a cross-wound package/empty tube change is due, this is signalled by the workstation 2, i.e. the workstation 2 concerned sends a work order to the central control unit 11 of the open-end spinning machine 1, as indicated in FIG. 3 by the lightning symbol 39. The central control unit 11 then in turn notifies a service unit 5, in the present embodiment example a cleaner and changer carriage, which immediately runs to the relevant workstation 2 and positions itself. This means that as soon as the service unit 5 is notified via the bus system 12 of the open-end spinning machine that there is a work order at one of the workstations 2, for example because the cross-wound package 7 has reached a predetermined diameter at the workstation 2 and has to be replaced by an empty tube 9, the service unit 5 runs to the relevant workstation 2, positions itself there and conveys the finished cross-wound package 7 onto a cross-wound package transport device. In practice, after the package cradle 8 of the winding device 4 has been opened, the service unit 5 transfers the completed cross-wound package 7 to the cross-wound package transport device 14 of the open-end spinning machine 1 by means of a take-off and drive arm.

At the same time, the tube conveyor belt 16 equipped with a plurality of empty tubes 9 is controlled in such a way that a new empty tube 9 is conveyed to the workstation 2 concerned in the fastest possible manner. The service unit 5 stops with its tube gripper 20, irrespective of the delivery direction, then the tube gripper 20 takes the empty tube 9 from the tube conveyor belt 16, on which there are generally numerous other empty tubes 9 lying ready, and inserts them into the package cradle 8 of the workstation 2.

While the cross-wound package transport device 14 of the textile machine 1 is conveying the completed cross-wound package 7 to a transfer point arranged at the end of the machine, a piecing thread 25 is provided by an auxiliary thread delivery device 22 of the cleaner and changer carriage 5, as has already been disclosed, that piecing thread 25 being drawn off from a reserve package 27 by a thread delivery unit 26 and is pneumatically transferred via a pivotally mounted delivery tube 28 into the area of a suction nozzle 29 belonging to the workstation, which sucks in the thread end. Then the delivery tube 28 transports the piecing thread 25 into the area of a thread positioning and repositioning device 23, which in turn brings the piecing thread 25 to the area of the empty tube 9 which is held in package cradle 8 of a workstation 2.

In the meantime, moreover, the free end of the piecing thread 25 has been transferred from the suction nozzle 29 to the workstation's (not shown) piecing tool, which prepares the thread end as usual.

By means of the prepared piecing thread 25, the piecing process is then started and the spinning thread freshly produced in the open-end spinning device 3 is placed on the empty tube 9 held in the package cradle 8 and rotationally acted upon by the winding drum 10.

LIST OF REFERENCE SIGNS

1 Open-end spinning machine
2 Workstation
3 Open-end spinning device
4 Winding device
5 Cleaner and changer carriage
6 Spinning can
7 Cross-wound package
8 Package cradle
9 Empty tube
10 Winding drum
11 Central control unit
12 Bus system
13 Control device
14 Cross-wound package transport device
15 Tube magazine
16 Tube conveyor belt
17 Guide rail
18 Guide rail
19 Control device
20 Tube gripper
21 Cleaning device
22 Auxiliary thread delivery device
23 Thread positioning and repositioning device
24 Thread traversing device
25 Piecing thread
26 Thread delivery unit
27 Reserve package
28 Thread delivery tube
29 Suction nozzle
30 Tube supply device
31 Tube detection device
34 Tube accumulator
35 Electric drive
36 RFID transponder
37 Tube distribution device
38 Double arrow
39 Work order
L Transport direction
R Transport direction

What is claimed is:

1. A textile machine producing cross-wound packages, the textile machine comprising:

a plurality of identical workstations, which are arranged in the area of the longitudinal sides of the textile machine and each of which has a winding device; and a tube supply device, which has a central tube magazine and has at least one tube conveyor belt installed in the area of the longitudinal sides of the machine, wherein a cross-wound package can be removed, if necessary, from the winding device of the relevant workstation on the textile machine producing cross-wound packages and can be transferred to a cross-wound package transport device, and an empty tube provided on the at least one tube conveyor belt of the tube supply device can be inserted by a tube gripper into the winding device of the relevant workstation, the tube supply device being designed in such a way that the at least one tube conveyor belt can be used as a tube accumulator for empty tubes during the operation of the textile machine producing cross-wound packages, characterised in that a drive is connected to the at least one tube conveyor belt, which drive enables reversible operation of the tube conveyor belt, and the empty tube is blocked at an end of the tube conveyor belt whereas the tube conveyor belt is first driven further in a corresponding direction.

2. The textile machine producing cross-wound packages according to claim 1, characterised in that a plurality of empty tubes can be stored on the tube conveyor belt during the operation of the textile machine.

3. The textile machine producing cross-wound packages according to claim 2, characterised in that each of the empty tubes stored on one of the tube conveyor belts has an identical configuration.

4. The textile machine producing cross-wound packages according to claim 2, characterised in that a plurality of empty tubes are stored on a tube conveyor belt and must be assigned to different yarn lots.

5. The textile machine producing cross-wound packages according to claim 2, characterised in that the empty tubes stored on the tube conveyor belts are identified for each specific lot.

6. The textile machine producing cross-wound packages according to claim 5, characterised in that the empty tubes identified for each specific lot have a special colour or special pattern.

7. The textile machine producing cross-wound packages according to claim 5, characterised in that the empty tubes are each equipped with an RFID transponder which has a lot-specific identification.

8. The textile machine producing cross-wound packages according to claim 1, characterised in that the textile machine has a tube detection device for the insertion of a suitable empty tube into the winding device of a workstation.

9. The textile machine producing cross-wound packages according to claim 8, characterised in that the tube detection device is configured as a colour sensor.

10. The textile machine producing cross-wound packages according to claim 8, characterised in that tube detection device is configured as an RFID reader.

11. The textile machine producing cross-wound packages according to claim 1, characterised in that the tube gripper is designed in such a way that, irrespective of the respective delivery direction (R or L) of the empty tube, the tube gripper can correctly pick up the empty tube from the tube conveyor belt and transfer it into the package cradle of the winding device of a workstation.

12. A method for operating a textile machine producing cross-wound packages, which comprises:

a plurality of identical workstations arranged in the area of the longitudinal sides of the textile machine, each workstation being equipped with a winding device; and a tube supply device, which has a central tube magazine and has at least one tube conveyor belt installed in the area of the longitudinal sides of the machine, in which method a cross-wound package is transferred if necessary from the winding device of the relevant workstation to a cross-wound package transport device running the length of the machine and then an empty tube provided on the at least one tube conveyor belt of the tube supply device is inserted by means of a tube gripper into the winding device of the relevant workstation, a plurality of empty tubes being stored on the at least one tube conveyor belt during the operation of the textile machine producing cross-wound packages, characterised in that the tube conveyor belt is reversed if necessary, and the empty tube is blocked at an end of the tube conveyor belt whereas the tube conveyor belt is first driven further in a corresponding direction.

* * * * *